United States Patent [19]

Owiriwo

[11] Patent Number: 4,962,800

[45] Date of Patent: Oct. 16, 1990

[54] DESIGNER HANDBAG

[76] Inventor: Adokiye S. Owiriwo, Box 26545, Raleigh, N.C. 27611

[21] Appl. No.: 402,465

[22] Filed: Sep. 5, 1989

[51] Int. Cl.[5] ..... A45C 3/06; A45C 13/08; A45C 13/10

[52] U.S. Cl. ..... 150/118; 150/127; 190/40; 190/119; 292/42; 292/175; 292/DIG. 50; D3/45

[58] Field of Search ..... 150/102, 118, 130, 128; 383/117, 86; 190/119, 120, 127, 902, 124; 292/DIG. 50, 42, 175; D3/45, 52, 54; D8/343, 338, 331; 70/67

[56] References Cited

U.S. PATENT DOCUMENTS

| | | | |
|---|---|---|---|
| D. 38,808 | 9/1907 | Grossman | D3/45 |
| D. 53,034 | 3/1919 | Finn | D3/45 |
| D. 257,081 | 9/1980 | Stern | D3/48 |
| D. 260,326 | 8/1981 | Siegel | D3/48 |
| D. 260,458 | 9/1981 | Siegel | D3/48 |
| D. 279,427 | 7/1985 | Emery | D3/42 |
| 1,245,132 | 10/1917 | Tarshis et al. | 292/42 |
| 1,520,038 | 12/1924 | Tueckmantel | 292/DIG. 50 X |
| 1,601,361 | 9/1926 | Hickingbotham | 150/128 |
| 1,638,594 | 8/1927 | Myers | 150/118 |
| 1,691,906 | 11/1928 | Lefkowitz | 150/118 |
| 1,695,706 | 12/1928 | Blacher | 292/DIG. 50 X |
| 1,735,043 | 11/1929 | Goldsmith | 150/118 |
| 1,768,496 | 6/1930 | Trager | 190/127 X |
| 2,103,281 | 12/1937 | Stanley | 190/902 X |
| 2,478,434 | 8/1949 | Swanson | 292/175 X |
| 2,907,196 | 10/1959 | Duttine | 292/42 X |
| 3,160,431 | 12/1964 | Anderson et al. | 292/42 |
| 4,153,092 | 5/1979 | Haslam . | |
| 4,677,832 | 7/1987 | Remington | 190/119 X |

FOREIGN PATENT DOCUMENTS

| | | | |
|---|---|---|---|
| 173808 | 1/1953 | Austria | 190/124 |

*Primary Examiner*—Sue A. Weaver
*Attorney, Agent, or Firm*—Jerry T. Kearns

[57] ABSTRACT

A designer handbag is formed as a flexible pouch having a top opening communicating with a hollow interior. Front and back surfaces of the pouch are formed from a fur pelt material. A flap is formed by a top portion of the back surface and is dimensioned to selectively close the open top. Opposite side surfaces and a bottom surface of the pouch are formed from a leather material. A metallic ribbing extends across the front and back surfaces at an intersection of the fur pelt and leather materials. An ornamental latch mechanism is provided for securing the flap in a closed position. Actuating buttons of the latch mechanism include settings for ornamental gems.

2 Claims, 2 Drawing Sheets

DESIGNER HANDBAG

BACKGROUND OF THE INVENTION

1. Field of the Invention

The present invention relates to handbags, and more particularly pertains to a new and improved designer handbag formed by leather and fur pelt materials and including an efficient and ornamental latch mechanism.

2. Description of the Prior Art

Various types of handbags are known in the prior art. A typical example of such a handbag is to be found in U.S. Pat. No. 4,153,092, which issued to B. Haslam on May 8, 1979. This patent discloses a handbag provided with a novel strap arrangement including a pair of carrying straps having button loops at the outer ends thereof. Cooperating buttons on each of the straps enable a configuration of the strap in either a handbag or shoulder bag mode. U.S. Design Patent No. 257,081, which issued to G. Stern on Sept. 30, 1980, discloses a handbag including a pair of carrying straps and a zipper closure. A plurality of individual pockets are provided on a front face of the handbag. U.S. Design Patent No. 260,326, which issued to M. Siegel on 25, 1981, discloses a handbag including a pair of carrying straps. U.S. Design Patent No. 260,458, which issued to M. Siegel on Sept. 1, 1981, discloses a handbag including a pair of carrying straps and a flap closure. U.S. Design Patent No. 279,427, which issued to G. Emery on Jul. 2, 1985, discloses a holster purse having a flap closure. The purse is mounted on an elongated backing sheet and includes a snap fastener.

While the above mentioned devices are directed to handbags, none of these devices disclose a designer handbag formed by a combination of fur pelt and leather materials and including an ornamental and efficient latch mechanism. Inasmuch as the art is relatively crowded with respect to these various types of handbags, it can be appreciated that there is a continuing need for and interest in improvements to such handbags, and in this respect, the present invention addresses this need and interest.

SUMMARY OF THE INVENTION

In view of the foregoing disadvantages inherent in the known types of handbags now present in the prior art, the present invention provides an improved designer handbag. As such, the general purpose of the present invention, which will be described subsequently in greater detail, is to provide a new and improved designer handbag which has all the advantages of the prior art handbags and none of the disadvantages.

To attain this, a representative embodiment of the concepts of the present invention is illustrated in the drawings and makes use of a designer handbag which is formed as a flexible pouch having a top opening communicating with a hollow interior. Front and back surfaces of the pouch are formed from a fur pelt material. A flap is formed by a top portion of the back surface and is dimensioned to selectively close the open top. Opposite side surfaces and a bottom surface of the pouch are formed from a leather material. A metallic ribbing extends across the front and back surfaces at an intersection of the fur pelt and leather materials. An ornamental latch mechanism is provided for securing the flap in a closed position. Actuating buttons of the latch mechanism include settings for ornamental gems.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially those who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved designer handbag which has all the advantages of the prior art handbags and none of the disadvantages.

It is another object of the present invention to provide a new and improved designer handbag which may be easily and efficiently manufactured and marketed.

It is a further object of the present invention to provide a new and improved designer handbag which is of a durable and reliable construction.

An even further object of the present invention is to provide a new and improved designer handbag which is susceptible of a low cost of manufacture with regard to both materials and labor, and which accordingly is then susceptible of low prices of sale to the consuming public, thereby making such handbags economically available to the buying public.

Still yet another object of the present invention is to provide a new and improved designer handbag which provides in the apparatuses and methods of the prior art some of the advantages thereof, while simultaneously overcoming some of the disadvantages normally associated therewith.

Still another object of the present invention is to provide a new and improved designer handbag formed by an attractive combination of fur pelt and leather materials.

Yet another object of the present invention is to provide a new and improved designer handbag having an ornamental and efficient latch mechanism.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
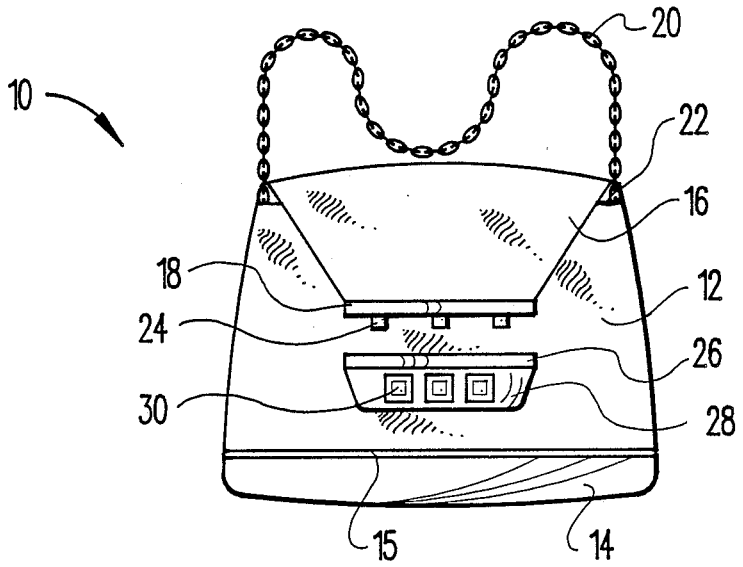
FIG. 1 is a front view of the designer handbag according to the present invention.

With reference now to the drawings, and in particular to FIG. 1 thereof, a new and improved designer handbag embodying the principles and concepts of the present invention and generally designated by the reference numeral 10 will be described.

More specifically, it will be noted that the first embodiment 10 of the invention includes a flexible pouch having a top opening communicating with a hollow interior. The top opening 22 is covered by a closure flap 16. A front face 12 of the handbag 10 is preferably formed from a fur pelt material, for example black gama mink. A variety of different furs in many different colors may alternatively be utilized. A carrying strap 20 may be formed by a metallic chain, or alternatively by a leather or fur pelt carrying strap. A bottom surface 14 of the bag 10 is formed by a flexible leather material, preferably of a color to coordinate with the fur pelt material utilized to form the front surface 12. A metallic ribbing 15 extends across the front face 12, at an intersection with the bottom surface 14. The metallic ribbing 15 is preferably of a silver or gold tone, and is coordinated with the carrying chain 20. A metallic bar 18 extends across a free edge of the closure flap 16 and includes a plurality of downwardly extending spaced parallel catch members 24. The catch members 24 and bar 18 are preferably formed from a metallic material in either a silver or gold tone. A silver or gold plated process may be utilized. A latch body 28 extends laterally across a central zone of the front surface 12 of the bag 10. A plurality of actuating buttons 30 are spaced along the front surface of the latch body 28. Each of the latch actuating buttons 30 preferably includes a setting for an ornamental gem. A variety of semi-precious or precious stones may be employed. An upper portion 26 of the latch body 28 may be provided with a silver or gold plating.

Figure 2:
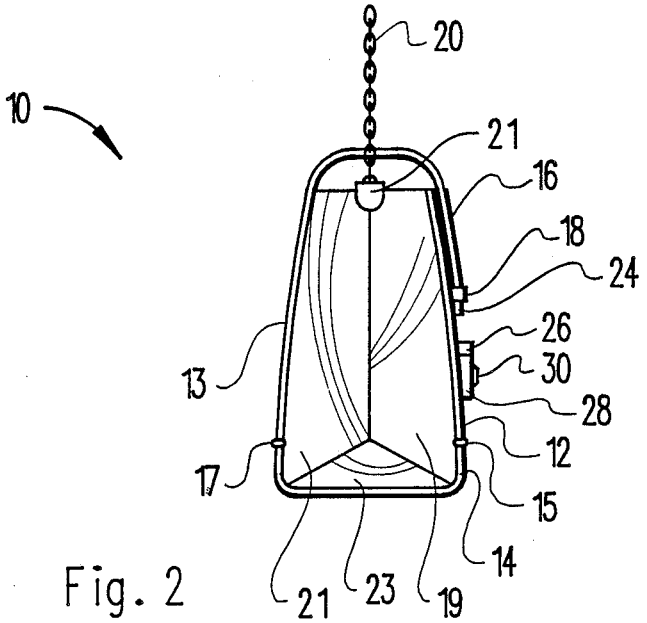
FIG. 2 is a side elevational view of the designer handbag of the present invention.

As shown in the side view of FIG. 2, the carrying chain or strap 20 is secured to a side surface of the bag 10 by a reinforced fastening boss 21.

The flap 16 is formed by a continuation of the back surface 13 of the bag 10. The back surface 13 is preferably formed from a fur pelt material to match the front surface 12 and flap 16. A metallic ribbing 17 extends laterally across the back surface 13, at the intersection with the leather bottom surface 14. The side surface of the bag 10 is formed by three intersecting facets 19, 21 and 23. Each of these facets is preferably formed from a flexible leather material, to match the leather material of the bottom surface 14. As illustrated, the facets form a pleated construction which allows expansion of the interior volume of the bag 10, depending upon the contents thereof.

Figure 3:
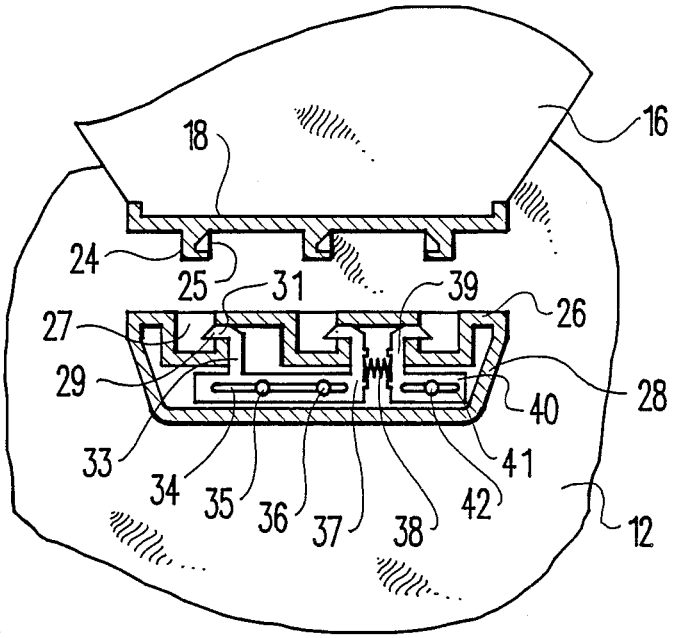
FIG. 3 is a detail view, partially cut away and in cross section, illustrating the closure latch mechanism of the designer handbag of the present invention.

FIG. 3 is a detail view which illustrates the construction of the flap latching mechanism of the designer handbag of the present invention. A plurality of rectangular catch members 24 extend from the bar 18 secured to the free edge of the closure flap 16. A generally triangular recess 25 is formed in a side face of each of the catch members 24. A latch body 28 extends laterally at a central zone on the front surface 12 of the handbag, generally parallel with the bar 18. A plurality of spaced rectangular wells 27 are formed in a top edge of the latch body 28. The wells 27 are dimensioned to receive the catch member 24. A latch cam 31 is received through a lateral aperture in each of the wells 27. Each of the latch cams have an inclined outer surface 29 dimensioned for engagement in one of the triangular recesses 25. A first group of latch cams 31 and 37 are mounted on a first slide block 33 which is received for reciprocal sliding movement within the latch body 28. A second group formed by the latch cam 39 is mounted on a second slide block 40 also received for reciprocal sliding movement within the latch body 28. It should be noted that a plurality of latch cams 39 may be provided on the second slide block 40, in conjunction with the provision of an additional number of cooperating wells 27 and catch members 24. The first slide block 33 includes an elongated slot 34 through which stationary guide pins 35 and 36 are received. The second slide block 40 includes a similar lateral slot 41 through which a stationary guide pin 42 is also received. A coil spring 38 is received between the slide blocks 33 and 40, biasing them apart. With reference to FIG. 1, at least two of the actuating buttons 30 include a reduced diameter stem portion received through a slot provided in the front surface of the latch body 28. These reduced stems are secured to the slide blocks 33 and 40. Thus, the two outer actuating buttons 30 may be pinched together, to move the slide blocks 33 and 40 together against the bias of the spring 38. This in turn causes the latch cams 31, 37 and 39 to be moved out of the wells 27, and out of engagement with the triangular recesses 25 provided in the catch members 24. This allows the closure flap 16 to be moved to an open position to allow access to the contents of the bag.

As may now be understood, the present invention provides an attractive designer handbag utilizing a mixture of natural fur pelts and color coordinated leather materials in conjunction with an improved ornamental and efficient latch mechanism.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A designer handbag, comprising:

a flexible pouch having a top opening communicating with a hollow interior;

front and back surfaces of said pouch formed from a fur pelt material;

a flap formed by a top portion of said back surface dimensioned to close said open top;

opposite side surfaces and a bottom surface of said pouch formed from a leather material;

a metallic ribbing extending across said front and back surfaces at an intersection of said fur pelt and leather materials;

a metallic bar extending across a free edge of said flap;

a plurality of rectangular catch members extending from said bar in spaced parallel relation;

a generally triangular recess formed in a side face of each of said catch members;

a latch body extending laterally at a central zone on said front surface, generally parallel with said bar;

a plurality of spaced rectangular wells formed in a top edge of said latch body, said wells each having a top opening, closed side and bottom walls, and said top openings of said wells dimensioned to receive said catch members;

a latch cam slidably received through a lateral aperture in a sidewall of each of said wells, each of said latch cams having an inclined outer surface dimensioned for engagement in one of said triangular recesses;

a first group of at least one of said latch cams mounted on a first slide block received for reciprocal sliding movement within said latch body;

a second group of at least two of said latch cams mounted on a second slide block received for reciprocal sliding movement within said latch body;

each of said first and second slide blocks having an elongated slot receiving a stationary guide pin;

said first and second groups of said latch cams facing in opposite directions;

a coil spring received between said first and second slide blocks and biasing said slide blocks apart;

a plurality of actuating buttons extending through a front face of said latch body, said actuating buttons operatively connected to move said slide blocks together to release said latch cams from engagement with said catch members;

and an ornamental gem secured to each of said actuating buttons.

2. A designer handbag, comprising:

a flexible pouch having a top opening communicating with a hollow interior;

said pouch having front and back surfaces;

a flap formed by a top portion of said back surface dimensioned to close said open top;

a metallic bar extending across a free edge of said flap;

a plurality of rectangular catch members extending from said bar in spaced parallel relation;

a generally triangular recess formed in a side face of each of said catch members;

a latch body extending laterally at a central zone on said front surface, generally parallel with said bar;

a plurality of spaced rectangular wells formed in a top edge of said latch body, said wells each having a top opening, closed side and bottom walls, and said top openings of said wells dimensioned to receive said catch members;

a latch cam slidably received through a lateral aperture in a sidewall of each of said wells, each of said latch cams having an inclined outer surface dimensioned for engagement in one of said triangular recesses;

a first group of at least one of said latch cams mounted on a first slide block received for reciprocal sliding movement within said latch body;

a second group of at least two of said latch cams mounted on a second slide block received for reciprocal sliding movement within said latch body;

each of said first and second slide blocks having an elongated slot receiving a stationary guide pin;

said first and second groups of said latch cams facing in opposite directions;

a coil spring received between said first and second slide blocks and biasing said slide blocks apart; and a plurality of actuating buttons extending through a front face of said latch body, said actuating buttons operatively connected to move said slide blocks together to release said latch cams from engagement with said catch members.

* * * * *